US008800606B2

(12) United States Patent
Cross et al.

(10) Patent No.: US 8,800,606 B2
(45) Date of Patent: Aug. 12, 2014

(54) WEAVING FINISHING DEVICE

(71) Applicants: Tory M. Cross, Portland, OR (US); Bhupesh Dua, Portland, OR (US)

(72) Inventors: Tory M. Cross, Portland, OR (US); Bhupesh Dua, Portland, OR (US)

(73) Assignee: Nike, Inc., Beaverton, OR (US)

( * ) Notice: Subject to any disclaimer, the term of this patent is extended or adjusted under 35 U.S.C. 154(b) by 15 days.

(21) Appl. No.: 13/748,758

(22) Filed: Jan. 24, 2013

(65) Prior Publication Data

US 2013/0186505 A1 Jul. 25, 2013

Related U.S. Application Data

(60) Provisional application No. 61/590,179, filed on Jan. 24, 2012.

(51) Int. Cl.
*D03J 1/08* (2006.01)
*D03D 41/00* (2006.01)

(52) U.S. Cl.
USPC ..... 139/291 C; 139/302; 139/116.1; 139/35

(58) Field of Classification Search
USPC ..... 139/302, 434, 450, 429, 435.1, 116.2, 139/291 C, 430, 263, 266, 1 R, 116.1, 170.4, 139/35, 50
See application file for complete search history.

(56) References Cited

U.S. PATENT DOCUMENTS 3,610,292 A * 10/1971 Wasyleviez ..... 139/434
3,621,885 A * 11/1971 Egloff et al. ..... 139/429
3,626,991 A * 12/1971 Backenecker ..... 139/434
3,779,289 A * 12/1973 Bulcock et al. ..... 139/266
3,814,140 A * 6/1974 Serturini ..... 139/302
3,879,824 A * 4/1975 Mizuno ..... 28/186
3,916,956 A * 11/1975 Harris et al. ..... 139/21
4,031,925 A * 6/1977 Santucci ..... 139/429
4,046,172 A * 9/1977 Russell ..... 139/33
4,077,438 A * 3/1978 Tanaka et al. ..... 139/302
4,448,223 A * 5/1984 Deborde et al. ..... 139/435.1
4,520,849 A * 6/1985 Suzuki et al. ..... 139/116.2
4,526,211 A * 7/1985 Suso ..... 139/430
4,546,802 A * 10/1985 Best ..... 139/336
4,600,039 A * 7/1986 Corain ..... 139/434
4,688,606 A * 8/1987 Tamatani ..... 139/116.2
4,756,343 A * 7/1988 Angebault et al. ..... 139/443
4,781,221 A * 11/1988 Onishi et al. ..... 139/116.1
4,815,498 A * 3/1989 Gryson et al. ..... 139/351
4,834,145 A * 5/1989 Lewyllie et al. ..... 139/429
4,834,147 A * 5/1989 Eberle et al. ..... 139/450
4,909,283 A * 3/1990 Verclyte ..... 139/1 C
4,917,153 A * 4/1990 Mori et al. ..... 139/435.1
4,957,144 A * 9/1990 Watanabe et al. ..... 139/434
4,964,442 A * 10/1990 Tacq et al. ..... 139/452
5,050,647 A * 9/1991 Baeck et al. ..... 139/450

(Continued)

*Primary Examiner* — Bobby Muromoto, Jr.
(74) *Attorney, Agent, or Firm* — Shook, Hardy & Bacon L.L.P.

(57) ABSTRACT

A dynamic finishing device that is able to finish one side of a product independently of a second side of the product while the product is being woven is provided. The sides may be finished in a non-linear fashion by the dynamic finishing device. Additionally, one or more finishing devices can be dynamically positioned in an interior portion of the woven product as it is being woven. Once positioned, the finishing devices may create apertures, pockets, and/or tunnels in the woven product and finish the edges of these creations. Finishing in the interior portions of the woven product occurs in the direction of the warp and in the direction of the weft.

13 Claims, 8 Drawing Sheets

(56) References Cited

U.S. PATENT DOCUMENTS

| | | | | | |
|---|---|---|---|---|---|
| 5,070,912 | A | * | 12/1991 | Ludwig | 139/188 R |
| 5,090,456 | A | * | 2/1992 | Kasahara | 139/302 |
| 5,105,855 | A | * | 4/1992 | Stacher | 139/35 |
| 5,105,856 | A | * | 4/1992 | Wahhoud | 139/194 |
| 5,158,119 | A | * | 10/1992 | Pezzoli et al. | 139/434 |
| 5,332,007 | A | * | 7/1994 | Wahhoud | 139/116.2 |
| 5,568,827 | A | * | 10/1996 | Debaes et al. | 139/450 |
| 5,575,314 | A | * | 11/1996 | Capitanio et al. | 139/429 |
| 5,649,570 | A | * | 7/1997 | Wahhoud et al. | 139/291 C |
| 5,669,424 | A | * | 9/1997 | Schiller et al. | 139/450 |
| 5,735,316 | A | * | 4/1998 | Hehle | 139/194 |
| 6,026,865 | A | * | 2/2000 | Krumm et al. | 139/453 |
| 6,039,086 | A | * | 3/2000 | Dornier et al. | 139/54 |
| 6,058,980 | A | * | 5/2000 | Scari et al. | 139/302 |
| 6,155,309 | A | * | 12/2000 | Berktold | 139/450 |
| 6,223,779 | B1 | * | 5/2001 | Speich | 139/302 |
| 6,260,586 | B1 | * | 7/2001 | Fratus | 139/291 C |
| 6,321,796 | B1 | * | 11/2001 | Sawada | 139/434 |
| 6,470,917 | B1 | * | 10/2002 | Yamamoto | 139/434 |
| 6,575,201 | B2 | * | 6/2003 | Buesgen | 139/387 R |
| 2002/0020457 | A1 | * | 2/2002 | Yamamoto | 139/434 |
| 2004/0154679 | A1 | * | 8/2004 | Yamamoto | 139/55.1 |
| 2005/0166989 | A1 | * | 8/2005 | Debaes et al. | 139/116.2 |
| 2006/0144458 | A1 | * | 7/2006 | Wahhoud et al. | 139/50 |

* cited by examiner

WEAVING FINISHING DEVICE

CROSS-REFERENCE TO RELATED APPLICATIONS

This application claims the benefit of priority of U.S. Provisional Application No. 61/590,179, filed Jan. 24, 2012 and entitled "Weaving Finishing Device." The entirety of the aforementioned application is incorporated by reference herein.

TECHNICAL FIELD

The present invention relates to woven textiles, apparel, accessories, and shoes. More specifically, the present invention relates to one or more finishing devices used to finish lateral portions and interior portions of a product as it is being woven.

BACKGROUND

Traditionally, lateral edges of a woven product have been finished in a linear fashion in the direction of the warp threads. The lateral edges are finished in such a manner as to maintain a uniform width of the product along its entire length. Further, edge finishing has typically been limited to the lateral margins of the woven product versus the interior portion of the woven product.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims At a high level, the present invention is directed to one or more finishing devices that can dynamically finish one side of a woven product independently of a second side of the woven product. For example, it is contemplated that a first (e.g., left) lateral side of a woven article may be finished independently of a second (e.g., right) lateral side of the woven article. The sides may be finished in a non-linear fashion (e.g., organic), which eliminates the need for at least some post-processing pattern cutting. Additionally, one or more finishing devices of the present invention can be dynamically positioned in an interior portion of the woven product as it is being woven. Once positioned, the finishing devices may create apertures, pockets, and/or tunnels in the woven product and finish the edges of these creations. Interior finishing may occur in the direction of the warp and in the direction of the weft.

Accordingly, one aspect of the present invention is directed to a finishing device comprising a positioning mechanism and a finishing mechanism coupled with the positioning mechanism.

A second aspect of the invention is directed to a finishing device system that comprises at least a first positioning mechanism and at least a second positioning mechanism. The finishing device system further comprises at least a first finishing mechanism coupled with the first positioning mechanism and at least a second finishing mechanism coupled with the second positioning mechanism. The first finishing mechanism is independently positionable with respect to the second finishing mechanism. The finishing device system further comprises a logic unit programmably-coupled to the first positioning mechanism, the second positioning mechanism, the first finishing mechanism, and the second positioning mechanism.

BRIEF DESCRIPTION OF THE DRAWINGS

Examples are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, the present invention is directed to one or more finishing devices that can dynamically finish one side of a woven product independently of a second side of the woven product. For example, a right side and a left side of a woven article may be finished independently of one another. The sides may be finished in a non-linear fashion, such as an organic geometry, which eliminates the need for at least some post-processing pattern cutting. Additionally, one or more finishing devices of the present invention can be dynamically (e.g., moveably) positioned in an interior portion of the woven product as it is being woven. Once positioned, the finishing devices may create apertures, pockets, and/or tunnels in the woven product and finish the edges of these creations. Interior finishing may occur in the direction of the warp and in the direction of the weft.

Figure 1:
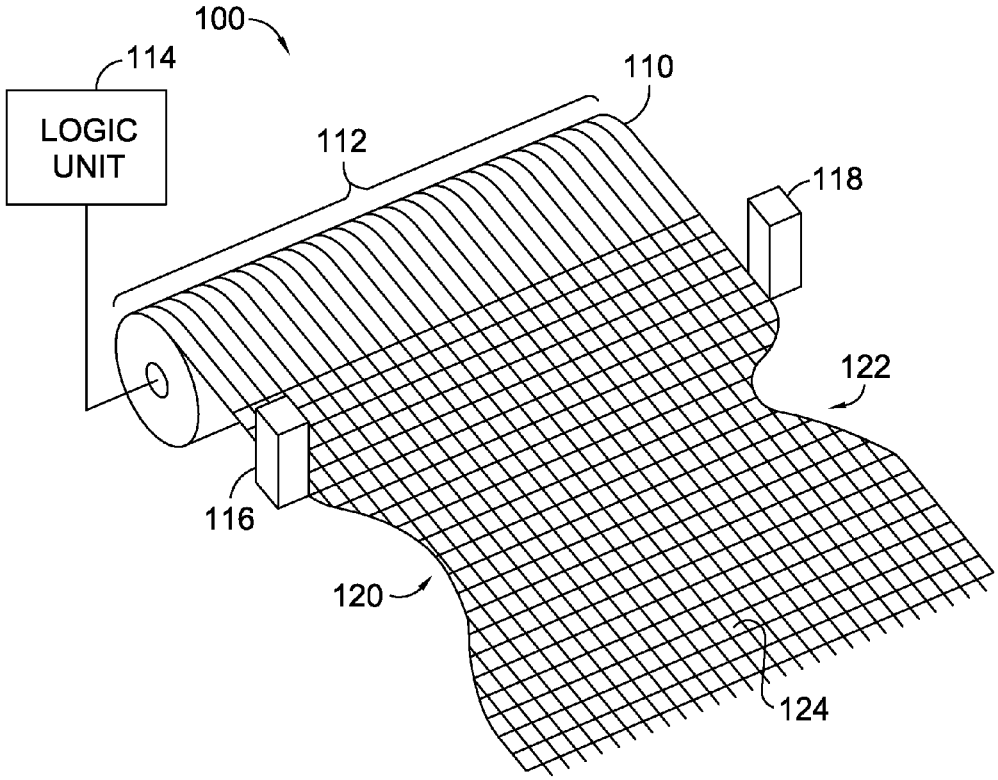
FIG. 1 depicts a top view of a loom with lateral finishing devices in an aspect of the present invention.

Turning now to FIG. 1, a top view of a loom 100 is depicted. The loom 100 is exemplary in nature and is used to illustrate certain aspects of one or more finishing devices. The loom 100 may comprise any type of weaving structure. For example, the loom 100 may comprise a single or multiple beam loom, a Jacquard loom, a Dobby loom, and other looms known in the art.

The loom 100 comprises a beam 110 that holds a set of warp threads 112 in tension. Although the term "thread" is used throughout this Specification for convenience sake, it is contemplated that the term "thread" may comprise any type of material (e.g., thread, yarn, string, braided material, extruded material, pulled material, spun material, and the like) formed from any substance including fabric materials, plastic materials, synthetic materials, metal materials, engineered materials, and the like. The loom also includes a first finishing device 116 and a second finishing device 118 that are positioned along the lateral edges of the loom 100 adjacent to a woven panel 124 (the woven panel 124 comprising warp threads interwoven with weft threads). While only two finishing devices are illustrated with respect to FIG. 1, it is contemplated that any number and combination of finishing devices may be implemented in exemplary aspects. Further, it is contemplated that a finishing device may be oriented in a variety of positions to finish in a variety of manners. For example, a tucker may be oriented to the left to form a right finished edge, or the tucker may be oriented to the right to form a left finished edge. The combination of finishing mechanisms is near limitless when considering types, locations, numbers, and orientations.

The finishing devices 116 and 118 may be manually attached to a supporting frame of the loom (not shown). Alternatively, the finishing devices 116 and 118 may be positioned on one or more positioning mechanisms. The positioning mechanisms may be functional for moving the finishing devices in any direction and/or rotation. For example, the positioning mechanisms may be functional for moving one or more finishing devices in a vertical, horizontal, and/or pivoting manner. In an exemplary aspect, it is contemplated that the positioning mechanism may be comprised of rotating arms that bring the finishing devices 116 and 118 in and out of position on the loom 100 and move the finishing devices 116 and 118 laterally in the direction of the weft threads. The rotating arms may raise and lower the finishing devices 116 and 118 in order to operate on different panels/layers of the woven product. In other contemplated aspects, the positioning mechanism may implement one or more screw drives, conveyors, belts, rapiers, pneumatics, hydraulics, and the like. Other ways of positioning finishing devices known in the art are contemplated to be within the scope of the invention.

With continued reference to FIG. 1, the finishing devices 116 and 118 are used to create a finished edge(s) of the woven panel 124 to create edge stability and prevent fraying of the edges. Edge finishing is important to maintain product integrity conceivably during post-weaving processing steps. The finishing devices 116 and 118 may use a tucker or a leno warp twister to create the selvedge or finished edge. Additional ways of creating a finished edge include singeing the edges with a singeing device especially when thermoreactive materials are being woven, and using a sintering laser when chemically-reactive materials are being woven or provided. Other forms of finishing are contemplated, such as ultrasonic, binding, surging, and the like.

The finishing devices 116 and 118 may be programmed to dynamically move laterally in and out of the woven panel 124 (in the direction of the weft threads) as the woven panel 124 is being fed through the finishing devices 116 and 118. The lateral movement of the finishing devices 116 and 118 may be changed with each weft that has been woven. This dynamic movement allows the woven panel 124 to be generated with a finished edge in any possible shape—not just a linear shape—as the woven panel is formed. Vision and/or optical systems may be used in conjunction with the finishing devices 116 and 118 to monitor the lateral movements of the finishing devices 116 and 118 with respect to the woven panel 124.

In an exemplary aspect, it is contemplated that the finishing device operating on one or more wefts finishes the one or more wefts while allowing one or more warps not interwoven with the one or more wefts to maintain continuity. Stated differently, when an organic lateral edge is formed with wefts finished at a location inside the beam width, warp threads will extend from the finished edge toward the lateral edge of the beam. These warp threads may not be terminated until post processing. The delay in terminating may allow for later woven wefts to utilize these wefts. However, it is also contemplated that warp threads outside the finished edge may be terminated at any point in the weaving process.

The finishing devices 116 and 118 may be programmably-coupled to a logic unit 114 by a wired or wireless connection. The logic unit 114 may execute a pattern program and instruct the finishing devices 116 and 118 based on the pattern program. Further, the logic unit 114 may also be programmably-coupled to the vision and/or optical systems of the finishing devices 116 and 118. The logic unit 114 may receive inputs from the vision and/or optical systems and, based on these inputs, instruct the finishing devices 116 and 118 to move laterally to a predetermined location based on the pattern program. Weaving and finishing the woven panel 124 according to the pattern program reduces the need to manually create the pattern shape after a panel has been woven.

The logic unit 114 may utilize one or more computer readable media having instructions maintained thereon for controlling one or more components. For example, it is contemplated that the logic unit 114 may have a processor and memory functional for executing instructions embodied on the computer readable media, such that by executing those instructions, one or more finishing devices, looms, vision systems, and the like may form a woven article with a finished edge. It is contemplated that a set of instructions identify a location at which a finishing device is to finish a woven article to produce a desired result. The instructions may be stored at the logic unit 114 and/or at a remote computing device, which communicates via a network connection (wired or wireless).

In addition to the logic unit 114, it is contemplated that the finishing mechanism and the positioning mechanism of a finishing device may have one or more computing mechanisms associated therewith. For example, the positioning mechanism may have a microcontroller associated that monitors the position and controls the drive system that operates the positioning mechanism. Similarly, the finishing mechanism may also have a microcontroller associated that controls one or more functions of the finisher. The finishing mechanism microcontroller may be responsible for ensuring components of the finishing mechanism are engaged. Together, a combination of logic unit, microcontrollers, and other components may work in concert to finish one or more edges, including internal edges, without direct human intervention.

The finishing devices 116 and 118 may be programmed to operate independently of each other. The result is a first edge 120 of the woven panel 124 that may have a different shape than a second edge 122 of the woven panel 124. As previously discussed, it is contemplated that the finishing device 116 and the finishing device 118 each have a positioning mechanism that operates independently of each other. As a result, each finishing device may move in a lateral direction that does not directly correlate with the other, when desired.

Figure 2:
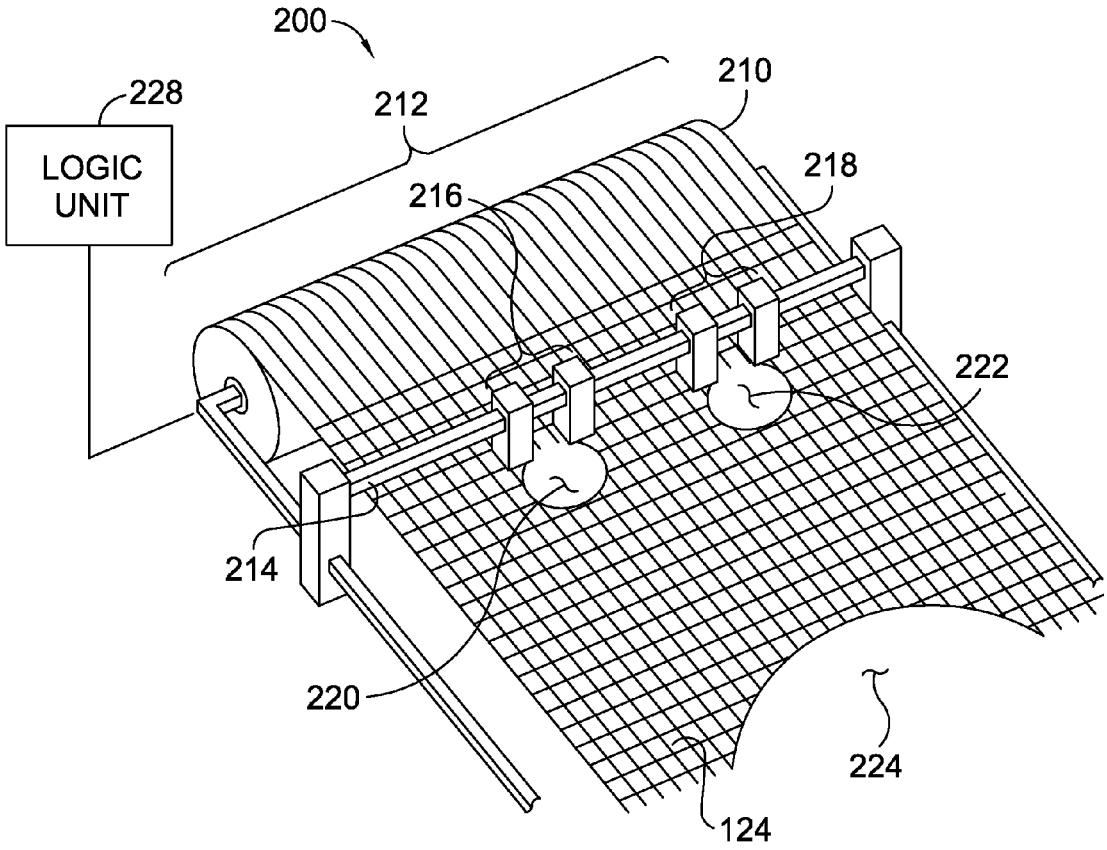
FIG. 2 depicts a top view of a loom with a plurality of interior finishing devices in an aspect of the present invention.

Turning now to FIG. 2, a top view of a loom 200 having a plurality of finishing devices located at an interior portion of a woven panel 226 is depicted. The loom 200 is exemplary in nature and is used to illustrate certain aspects of one or more finishing devices. The loom 200 may comprise any type of weaving structure. For example, the loom 200 may comprise a single or multiple beam loom, a Jacquard loom, a Dobby loom, and other looms known in the art.

The loom 200 comprises a beam 210 that holds a set of warp threads 212 in tension. As previously discussed, the term "thread" is not limiting, but instead used for the convenience of this description. The loom 200 also comprises a support beam 214 mounted to the frame of the loom 200. A first set of finishing devices 216 and a second set of finishing devices 218 are attached to the support beam 214. Other contemplated examples for maintain, positioning, and/or manipulating a positioning device comprise a multi-axis articulating robot, a rapier, piston-driven mechanism, screw drive, conveyor drive, belt drive, and the like.

The first and second set of finishing devices 216 and 218 may be movable along the support beam 214 through, for example, the use of a screw drive or rollers, as previously discussed. The first and second set of finishing devices 216 and 218 may be able to rotate around the support beam 214 so that the functional aspects of the finishing devices 216 and 218 may be alternately aligned in the direction of the weft threads or the warp threads. Alternatively, one finishing device of the first set of finishing devices 216 may be oriented to operate in the direction of the weft threads (e.g., a tucker), and the second finishing device of the set of finishing devices 216 may be oriented to operate in the direction of the warp threads (e.g., a leno twist); the same holds true for the second set of finishing devices 218. The first and second set of finishing devices 216 and 218 may be able to pivot out of the way when not in use.

In another exemplary arrangement that is not depicted, the first set and the second set of finishing devices 216 and 218 may be mounted on movable arms that act to raise, lower, or laterally move the first and second set of finishing devices 216 and 218. Further, the first set of finishing devices 216 may be operated and moved independently of the second set of finishing devices 218. Although only two sets of finishing devices are shown in FIG. 2, it is contemplated that a plurality of sets of finishing devices may be employed to generate a woven product. Any and all such aspects are within the scope of the invention.

As the loom 200 weaves the woven panel 226, the first and second set of finishing devices 216 and 218 cut and finish warp and/or weft threads to create apertures in the woven panel 226. For instance, as the loom 200 weaves the woven panel 226, the finishing devices 216 and 218 move laterally back and forth along a weft of the woven panel 226. The finishing devices 216 and 218 cut the weft threads and any warp threads 212 that are encountered and simultaneously finish the cut edges of the threads. The cut material may be finished by any of the methods outlined above with respect to FIG. 1 (tucking, leno warp twisting, singeing, sintering, melting, fusing, activation of bi-component materials, and the like). The sets of finishing devices 216 and 218 may have associated vision and/or optical systems to monitor the lateral movements of the finishing devices 216 and 218 with respect to the woven panel 226. However, as previously discussed, it is contemplated that the weft threads may be cut and finished while maintaining the warp threads for continuity purposes, in an exemplary aspect.

FIG. 2 illustrates two apertures 220 and 222 that are simultaneously being created by the first and second set of finishing devices 216 and 218. As can be seen, the apertures 220 and 222 are finished both in the direction of the warp threads 212 and in the direction of the weft threads. FIG. 2 also illustrates an additional aperture 224 that was created at an earlier point in the weaving process. The aperture 224 was created by one set of finishing devices (216 or 218), thus illustrating that the sets of finishing devices 216 and 218 may operate independently of each other. In this example, a cutting mechanism associated with or independent of the finishing device(s) may terminate (using any known method) those threads that form at least a portion of an internal aperture. For example, it is contemplated that the finishing devices 216 and 216 cut and finish the weft threads and the warp threads that form the internal portion of, for example, the aperture 220. In this example, the finishing devices may not form the aperture 220 until at least one weft has been inserted into the shed of the woven article that will extend across those warps that may be terminated.

The sets of finishing devices 216 and 218 may be programmably-coupled to a logic unit 228 by a wired or wireless connection. The logic unit 228 may execute a pattern program and instruct the sets of finishing devices 216 and 218 based on the pattern program. Further, the logic unit 228 may also be programmably-coupled to the vision and/or optical systems of the sets of finishing devices 216 and 218. The logic unit 228 may receive inputs from the vision and/or optical systems and, based on these inputs, instruct the sets of finishing devices 216 and 218 to move laterally a predetermined distance based on the pattern program. Weaving and finishing the woven panel 226 according to the pattern program reduces the need to manually create the apertures after a panel has been woven. Further, the systems depicted in FIGS. 1 and 2 enable the weaving and finishing of a variety of different patterns including organically-shaped patterns.

The finishing devices discussed above with respect to FIGS. 1 and 2 (i.e., finishing devices 116 and 118, and the sets of finishing devices 216 and 218) may be used on looms with multiple panel weaving capabilities. While weaving multiple panels simultaneously, the finishing devices may create apertures in the interior portion of one or more panels and create different lateral margins on each of the one or more panels. The edges of the apertures and the lateral margins may be finished by the finishing devices. In one aspect, the edges of the apertures may be woven to a corresponding panel(s) that is above or below the panel with the aperture to create one or more channels or pockets. Any and all such aspects are within the scope of the invention.

Figure 3:
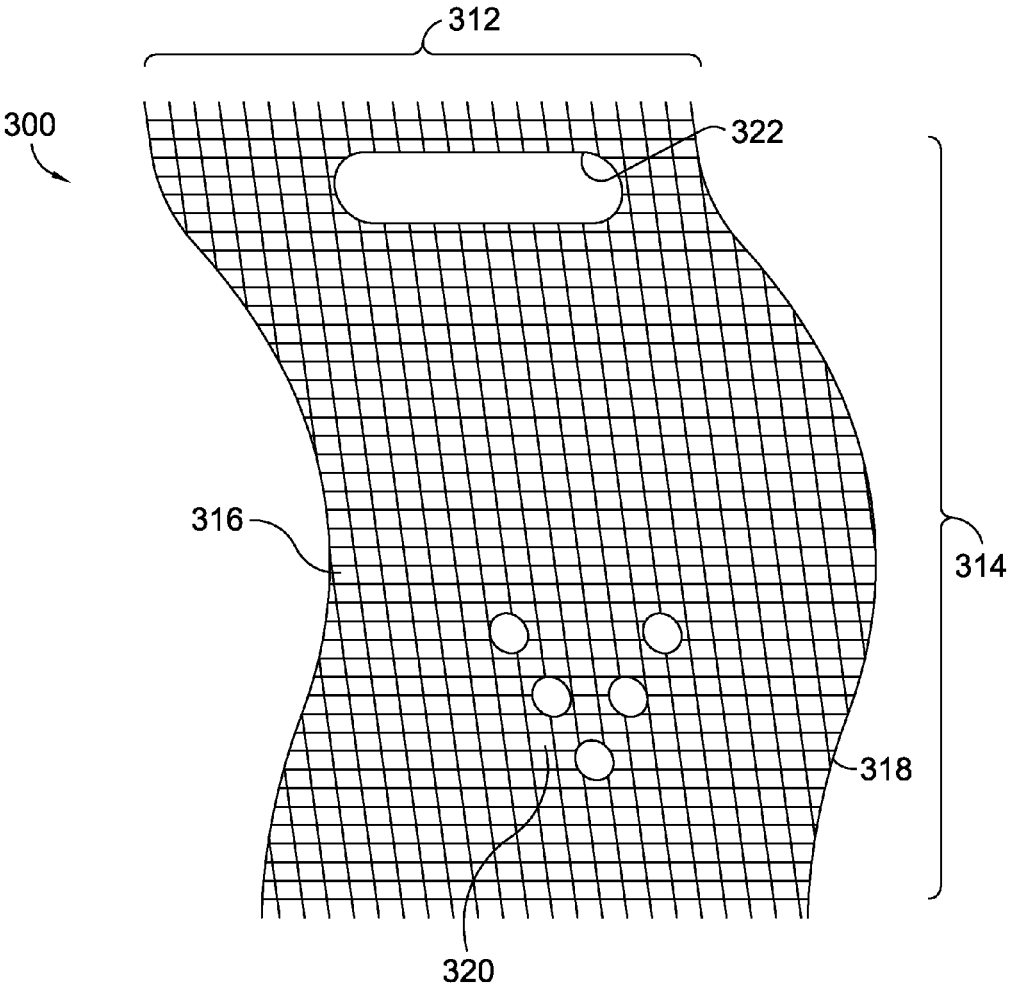
FIG. 3 depicts a portion of an exemplary woven product having lateral finished edges and interior apertures with finished edges in an aspect of the present invention.

FIG. 3 depicts a close-up view of a portion of an exemplary woven product 300 that may be produced by the finishing devices discussed above. The woven product comprises a series of warp threads 312 and a series of weft threads 314. Lateral finishing devices, such as the finishing devices 116 and 118 of FIG. 1, may be utilized to create lateral edges 316 and 318 of the woven product 300. The lateral edges 316 and 318 may be organically-shaped or geometrically-shaped. Further, the lateral edge 316 may be shaped the same as or different from the lateral edge 318. The lateral finishing devices may finish the lateral edges 316 and 318 using a tucker, a leno warp twister, a singeing device, a sintering laser, and the like.

Apertures 320 may be created by one or multiple sets of interior finishing devices as discussed above with respect to FIG. 2. The apertures 320 may be small to create a mesh-like pattern, medium-sized to create functional apertures for cording or webbing to pass through, or they can be large allowing pattern parts to separate and connect. The edges of the apertures 320 may be finished. The edges of the apertures 320 may be woven to the edges of apertures in woven panels situated above and below the woven product 300. The weaving together of multiple apertures stacked on top of each other may help to create channels through the woven product 300.

The woven product 300 also comprises an additional aperture 322 that may be constructed by one or more sets of finishing devices. The edges of the aperture 322 may be woven to panels above and below the aperture 322 to create a pocket in the woven product 300. Similarly, a portion of the edges of the aperture 322 may be woven to a panel below the aperture 322 to create an accessible pocket.

Further, it is contemplated that a warp thread separator may be used in conjunction with one or more components of a finishing device. For example, it is contemplated that a warp thread separator may be a wedge-like structure that is inserted between two warp threads that will eventually form the lateral edges of an internal aperture. By forcibly parting two traditionally parallel warp threads prior to (or contemporaneously with) the finishing of weft threads, an aperture may be formed that maintains the continuity of warp threads throughout the warp length of the woven article. It is contemplated that the finishing of the weft threads around each of the separated warp threads maintains the separated warp threads in a desired position, which may be in a non-parallel orientation.

In another exemplary aspect, it is contemplated that a series of finishing devices may be implemented to result in a desired aperture. For example, a leno warp twister may finish a plurality of warp threads in a number of substantially parallel twisted warps. Once the leno warp twister has twisted the warps, another finishing device may be implemented that cuts wefts between two substantially parallel twisted warps and proceeds to tuck each respective new weft end about a proper twisted warp. Further, it is contemplated that a warp separator may separate the two substantially parallel twisted warp groupings as the tucking of the wefts occurs.

A hubless leno warp twister is contemplated as being positioned on one or more internal (medial of the lateral-most warp threads) warp threads. In this example, when an aperture is desired at an internal position of the woven article, the hubless leno warp twister may be positioned on the corresponding warps that are positioned in the lateral direction of the aperture. In this example, the finishing device may include a tucker and a cutter that are functional for forming an aperture between the twisted warp groupings.

Figure 4:
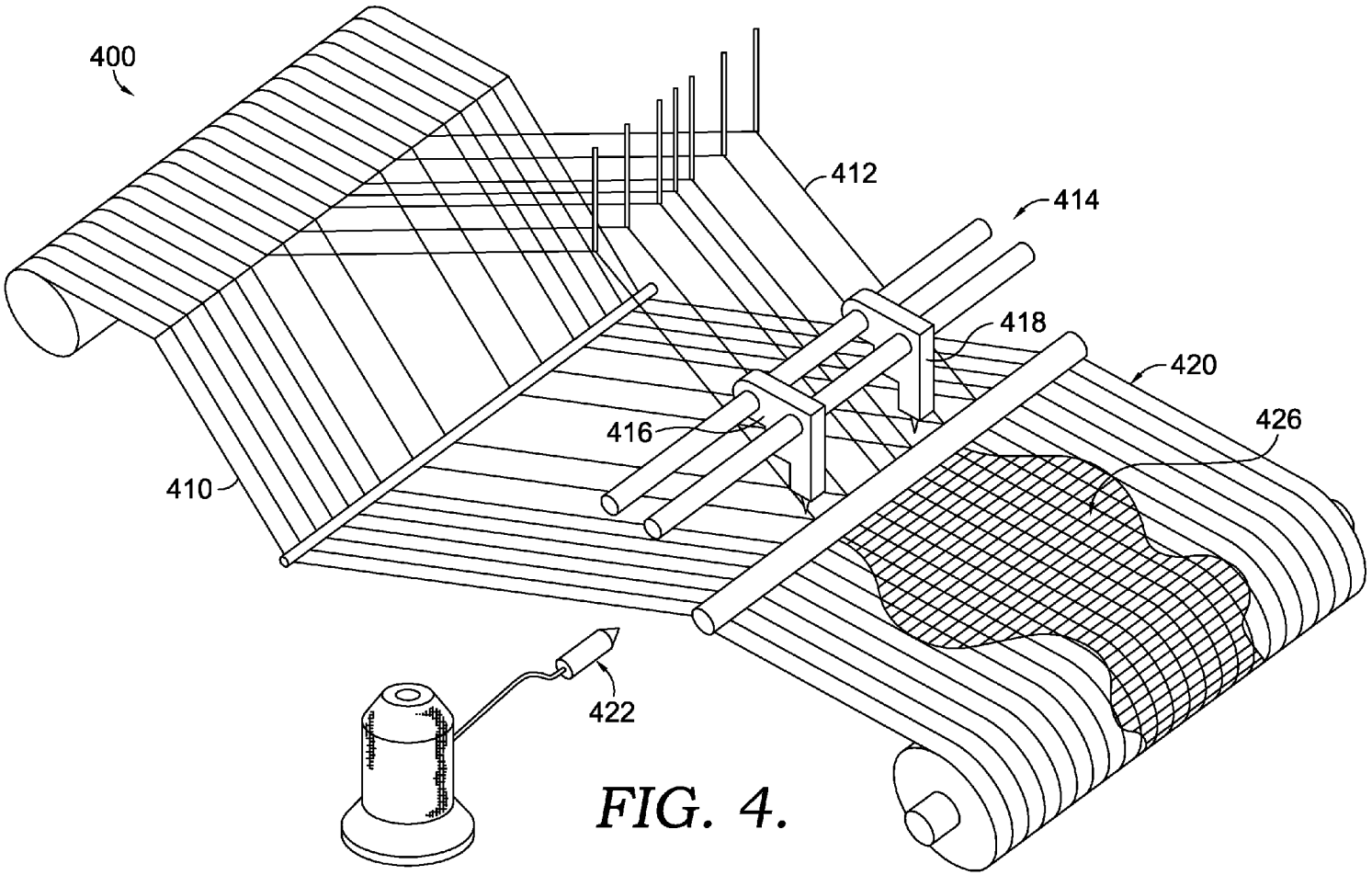
FIG. 4 depicts a top view of a loom having a plurality of finishing devices and a Jacquard device.

FIG. 4 depicts a top view of a loom 400 having a plurality of finishing devices and a Jacquard device, in accordance with aspects of the present invention. The loom 400 is comprised of a warp beam constructed with a plurality of warp threads (e.g., warp threads 410 and 412). The warp threads may be selectively positioned up or down based on manipulation by Jacquard needles 424. In the present illustration, only those Jacquard needles maintain warps in an up position are illustrated, but it is contemplated that even those warps in the down position also are associated with Jacquard needles. The loom 400 incorporates a first finishing device 416 and a second finishing device 418. The finishing devices are positionable dynamically using a positioning mechanism 414. As illustrated in this exemplary aspect, the positioning mechanism is comprised of two rods, which may be screw drives. For example, it is contemplated that the first finishing mechanism 416 is actively engaged to a first of the two rods and passively engaged with the second rod. Similarly, it is contemplated that the second finishing mechanism 418 is actively engaged with the second of the two rods and passively engaged with the first rod. When actively engaged with a rod, the rod is functional to move the finishing device laterally (or pivotally). When passively engaged, the finishing mechanism may be allowed to be supported by the rod, but not actively positioned by that rod.

As depicted in FIG. 4, warp threads that are not interwoven with weft threads to form a portion of a woven article 426 may be left in a down position (or any position) when a weft thread, as provided by a weft loader 422, is being inserted into the warp threads. Further, it is contemplated that the warp threads not interwoven with weft threads (e.g., warp thread 420) may be allowed to maintain continuity for the length of the weaving process to ensure consistent tension and other characteristics. As such, it is contemplated that the warp threads not interwoven with weft threads may be separated from the woven article 426 in a post processing procedure. Further, the non-interwoven warp threads may be removed at the time of forming the woven article 426, in an exemplary aspect.

In the illustrated aspect of FIG. 4, the finishing devices 416 and 418 are positioned proximate the weft insertion place; however, it is contemplated that one or more of the finishing devices may be positioned at any location. For example, a warp finishing device may be positioned prior to the insertion of the weft thread. Further, it is contemplated that a weft finishing device may be positioned at a location post-weft insertion and weft packing. Therefore, one or more finishing devices may be located at any location along the formation of a woven article.

As previously discussed, it is contemplated that a number of possible internal apertures may be formed using one or more finishing devices. For example, FIGS. 5-11 illustrate various arrangements and techniques for forming an aperture in an internal portion of a woven article, in accordance with aspects of the present invention.

Figure 5:
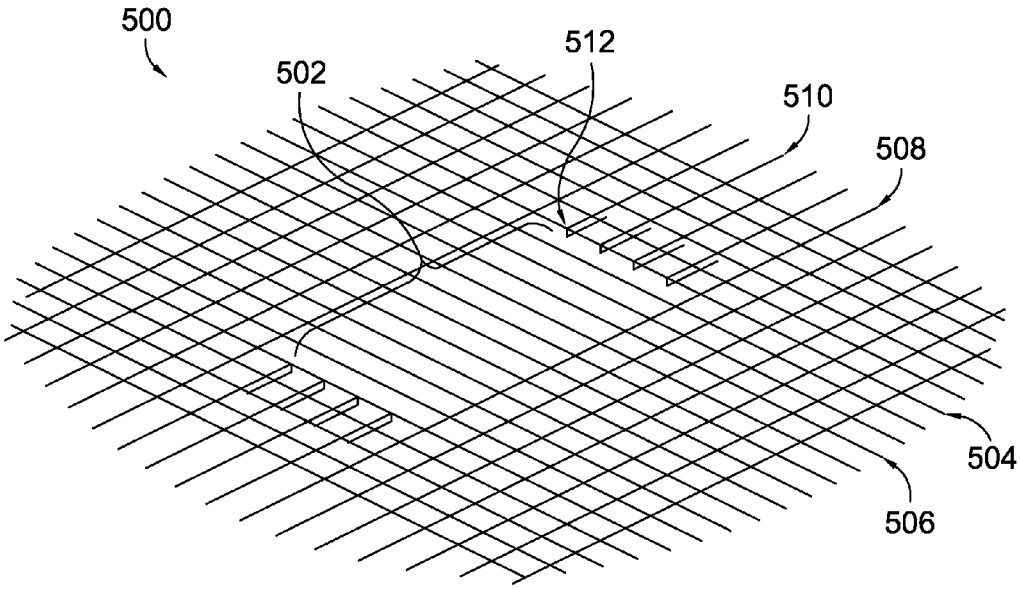
FIGS. 5-11 depict exemplary portions of a woven articles comprised of internal apertures formed, at least in part, with one or more finishing devices, in accordance with aspects of the present invention.

FIG. 5 depicts a portion of a woven article 500 comprised of an internal aperture 502, in accordance with aspects of the present invention. The aperture 502, in this example, is formed by finishing one or more weft (i.e., fill) threads to form a portion of the aperture 502 perimeter. In this illustration, a series of warp threads, such as a warp thread 504 and a warp thread 506 extend through the woven article 500. The warp threads are interwoven with a series of weft threads. A portion of the weft threads, such as weft thread 510, are finished at an internal portion of the woven article. Other weft threads, such as a weft thread 508 extend the length of the warp beam, in this example.

The aperture 502 is formed by finishing (e.g., tucking) the weft threads that would otherwise cross a desired internal aperture. For example, the weft 510 is tucked around the warp 504 at a tuck 512. The finishing may occur during the weaving process (e.g., prior to packing by a comb, subsequent to packing by a comb) and/or the finishing may occur as a post-process procedure. The aperture 502 is formed with substantially linear perimeter edges. Other apertures discussed herein (e.g., an aperture 602 of FIG. 6) may have gradient edges on the perimeter. It is contemplated that any form of finishing may be implemented on the warps and/or the wefts (and in any combination). For example, the various threads may be finished with a fold and weld process, a tucking process, a singeing process, an activation process (e.g., heat activation), and other finishing techniques discussed herein.

Figure 6:
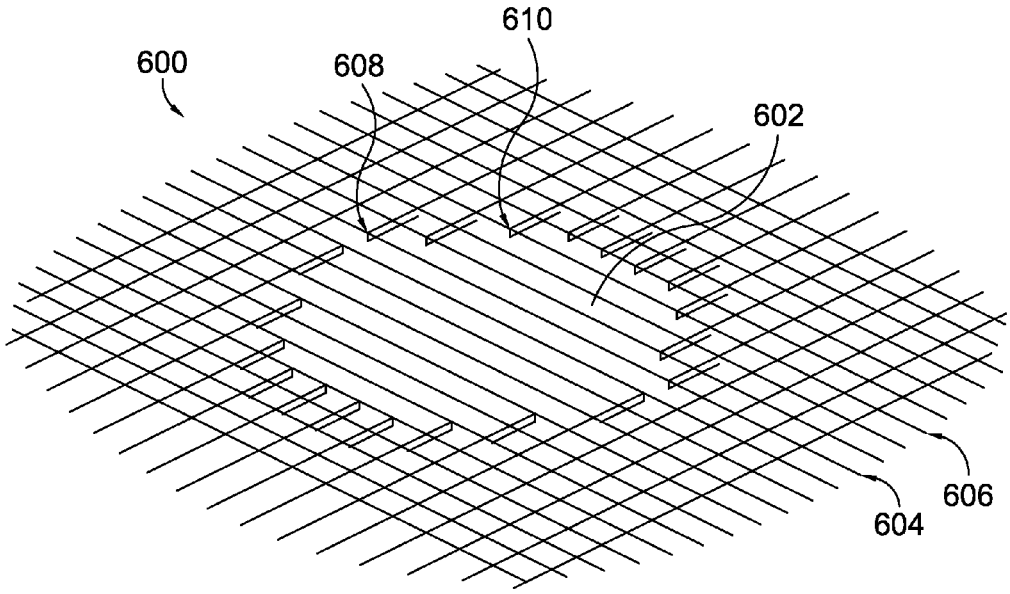

FIG. 6 depicts a portion of a woven article 600 comprised of an internal aperture 602, in accordance with aspects of the present invention. The article 600 is formed with a plurality of warps, such as warps 604 and 606. The article 600 is also formed with a plurality of wefts, such as wefts 608 and 610. The aperture 602 is formed having a gradient perimeter (e.g., semi-circular in appearance). This gradient perimeter may be accomplished by adjusting which of a plurality of warps onto which a weft extends. For example, the weft 608 extends farther than the weft 610, forming a graduated perimeter of the aperture 602. In this example, the warps continue to extend through the aperture 602; however, it is contemplated that the warps extending into the aperture 602 may be removed by one or more finishing techniques discussed herein. The warp removal may occur at any point after a subsequent weft is interwoven with the to-be-finished warp, in an exemplary aspect.

Figure 7:
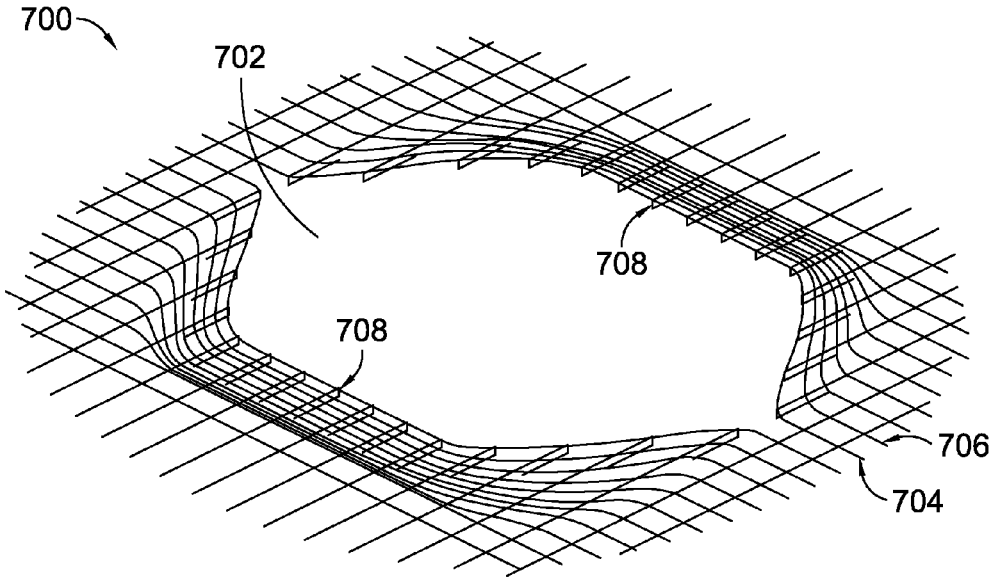

FIG. 7 depicts a portion of a woven article 700 comprised of an internal aperture 702, in accordance with aspects of the present invention. The internal aperture 702 is formed, in this example, through the pulling of the warp threads that would otherwise transverse the aperture to a side of the aperture. The pulling of the warp threads may be accomplished using a lateral-moving heddle, a warp separator (discussed hereinabove), and/or a weft tensioning process. The weft tensioning process may exert a lateral force that draws or pulls one or more warps away from an aperture to be formed. This force may be exerted as the weft is being finished to prevent an excess material accumulation. Further, it is contemplated that the weft may be pulled from a lateral edge after the finishing process is applied (and potentially prior to packing by a comb). Other exemplary aspects are contemplated.

The moveable warp concept is exemplified in FIG. 7 having a plurality of warps, such as warps 704 and 706. The warps are interwoven with a plurality of wefts, such as weft 708 and 710. The weft 708 is finished on a left side of the aperture 702 and the weft 710 is finished on the right side of the aperture 702 proximate the warp 704. The wefts maintain the warps that would otherwise traverse the aperture 702 in an offset location allowing for the formation of the aperture 702 with minimal finishing of the warps. In this example, the warps may not need a finishing process done, which may aid in maintaining the continuity of the warps through the length of the woven article 700.

Figure 8:
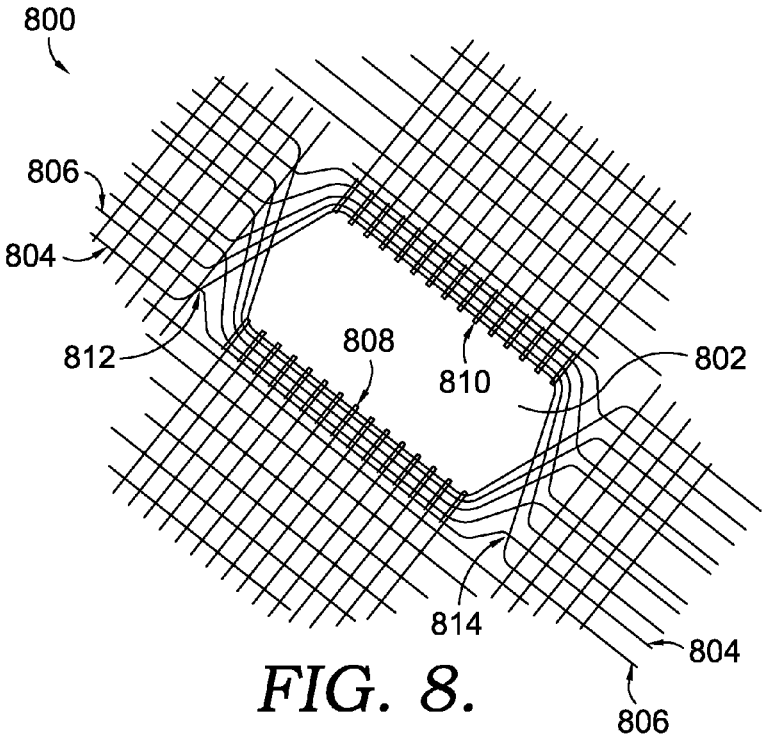

FIG. 8 depicts a portion of a woven article 800 comprised of an internal aperture 802, in accordance with aspects of the present invention. The aperture 802, in this example, is contemplated as being formed using a series of leno twist-like operations on one or more of the warp that would otherwise traverse the aperture 802. For example, a warp 804 and a warp 806 are initially twisted at a location 812 prior to diverging to opposite sides of the aperture 802. The warps 804 and 806 are then again twisted at a location 814 at a distant end of the aperture 802. The twisted warps are maintained in a separated position with one or more finished wefts, such as wefts 808 and 810. It is contemplated that any number of twists may be implemented prior to or following the aperture 802.

Figure 9:
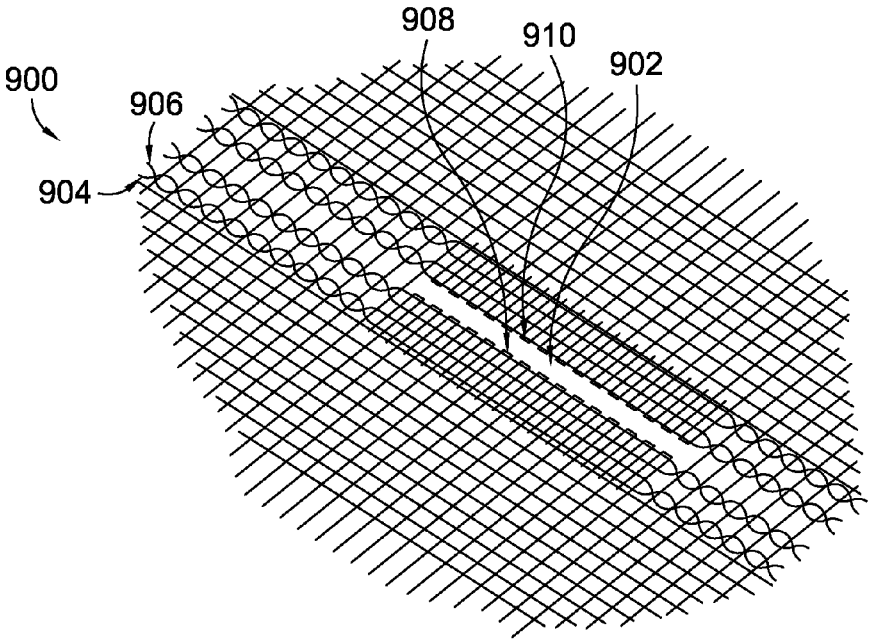

FIG. 9 depicts a portion of a woven article 900 comprised of an internal aperture 902, in accordance with aspects of the present invention. The internal aperture 902, in this example, is formed having one or more twisted pairs of warps forming the lateral perimeter of the aperture 902. For example, it is contemplated that a leno warp twist process is applied to a warp 904 and a warp 906. While the twisting is not illustrated as continuing along the perimeter of the aperture 902, other aspects may implement a twist in conjunction with one or more wefts finished to form the aperture 902. Further, it is contemplated that a twist process may begin at any point during the weaving process and is not required, in an exemplary aspect, to continue along the length of the woven article. Stated differently, a twist of two or more warps may commence at any weft and may terminate at any weft. A first side of the aperture is formed with a termination of a weft 908 and a second side of the aperture is formed with the termination of the weft 910.

Figure 10:
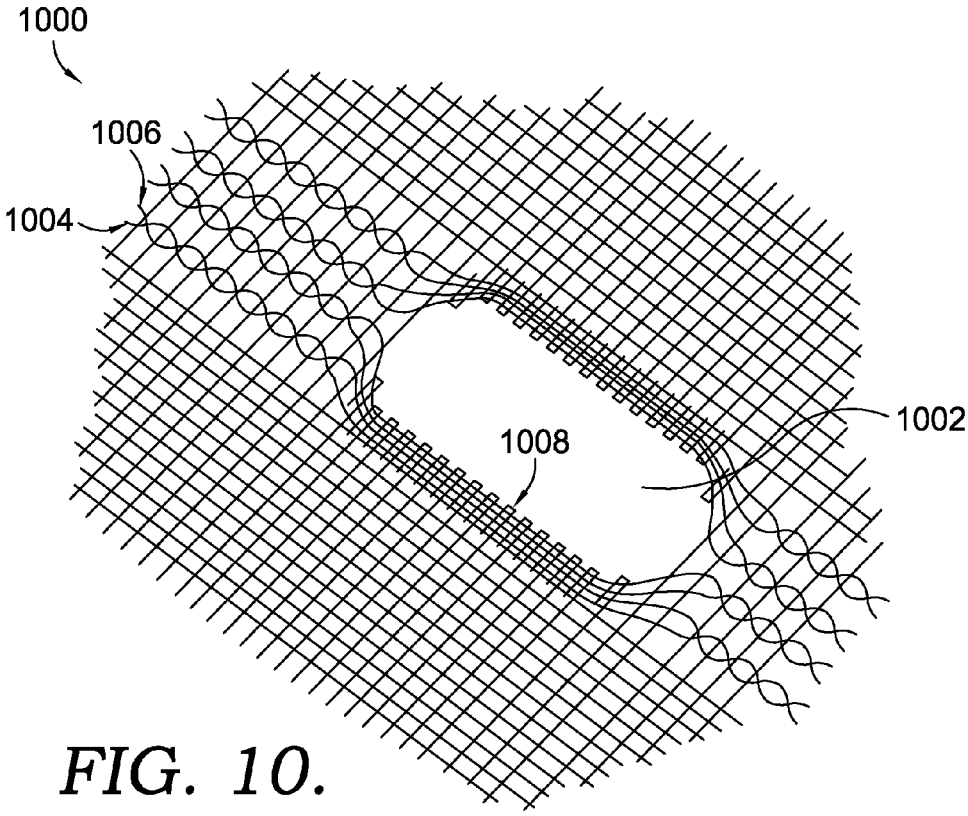

FIG. 10 depicts a portion of a woven article 1000 comprised of an internal aperture 1002, in accordance with aspects of the present invention. The aperture 1002 may be formed in manner similarly discussed with respect to FIG. 9. However, unlike that which is depicted in FIG. 9, the aperture 1002 is formed with a separating of two or more twisted warps, which may then be maintained in a separated position with one or more wefts, such as a weft 1008. As discussed with respect to FIG. 7, it is contemplated that a number of mechanisms may be implemented for moving the warp threads from their aligned position to an offset position. For example, it is contemplated that a warp separator, a laterally moveable heddle, and/or a weft tension force may be implemented to move the one or more warp to an offset position, which creates, at least in part, the aperture 1002.

It is contemplated that an aperture may have any shaped perimeter. For example, multiple curves having varied radii in various directions (e.g., different sized concave and convex-oriented curves) may be formed as a portion of the perimeter. Further, an aperture may be formed using any combination of techniques discussed herein. For example, a leno warp twist may be used to form one portion of the perimeter and an alternative technique may be used to form another portion of the perimeter, in an exemplary aspect.

Figure 11:
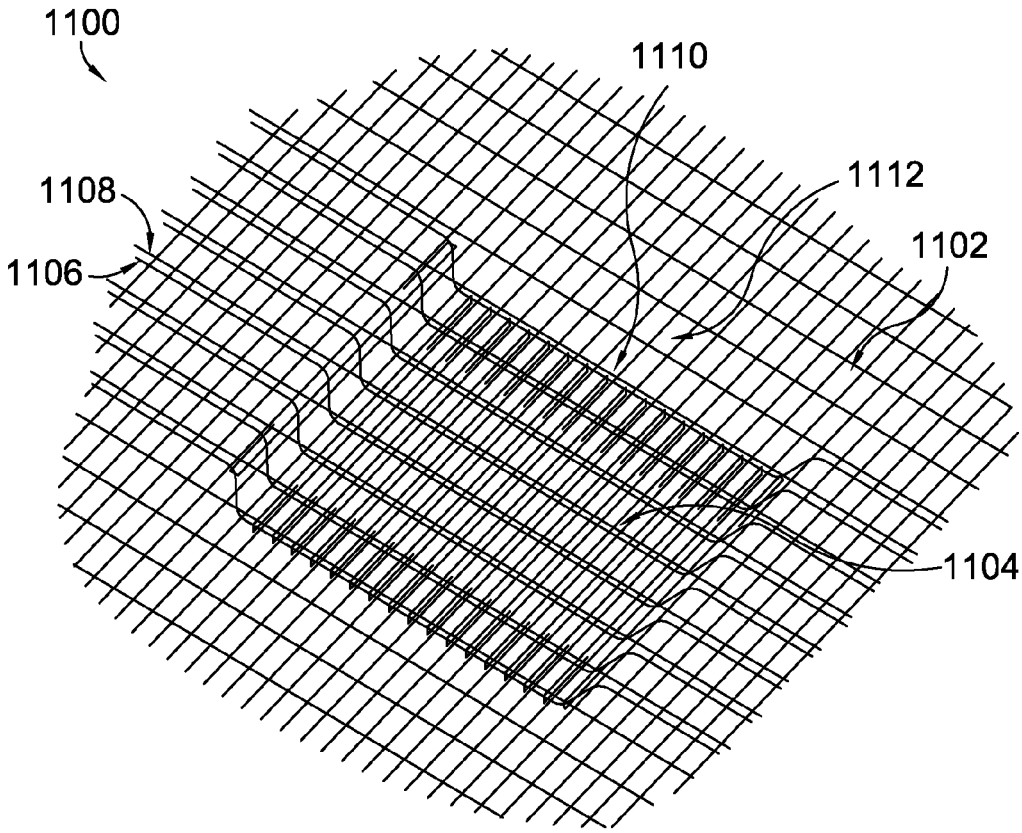

FIG. 11 depicts a portion of a woven article 1100 comprised of two layers 1102 and 1104, in accordance with aspects of the present invention. The first layer 1102 may extend in a substantially planar manner while the second layer 1104 may deviate from the first layer 1102 to form a channel or pocket. For example, it is contemplated that a first warp 1108 form a portion of the first layer 1102. And a second warp 1106 is pulled down to form a portion of the second layer 1104. This two-layer approach may allow for a channel through which a material may pass (e.g., webbing, thread, yarn, clips, and the like). Similarly, it is contemplated that the wefts may extend from the first layer to the second layer at one end of the channel to form a pocket-like enclosure. The open end of the pocket-like enclosure may be finished in one or more techniques provided herein.

As depicted in FIG. 11, a weft 1112 is interwoven with one or more warps forming the first layer 1102. A weft 1110 is interwoven with one or more warps forming the second layer 1104. While the weft 112 may be woven in a traditional manner, it is contemplated that the weft 1110 may be finished at one or both ends to form a pocket or channel respectively.

As previously discussed, a Jacquard-type machine may be implemented to raise and lower the appropriate warps at the appropriate time to form the first and the second layer. Other techniques are contemplated for forming the multi-layered woven article.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

The invention claimed is:

1. A finishing device, the finishing device comprising:

a positioning mechanism;

a finishing mechanism, the finishing mechanism coupled with the positioning mechanism; and wherein the finishing mechanism having at least a cutter that operates to cut both warp and weft threads.

2. The finishing device of claim 1, further comprising:

a logic unit programmably-coupled to the finishing device and the positioning mechanism.

3. The finishing device of claim 1, wherein the finishing device is located along a lateral beam edge.

4. The finishing device of claim 1, wherein the finishing device is located in an interior portion of a beam.

5. The finishing device of claim 1, wherein the finishing device moves in a lateral direction.

6. The finishing device of claim 5, wherein the finishing device moves in the direction of a weft thread.

7. The finishing device of claim 1, wherein the finishing device is functional to finish warp threads.

8. The finishing device of claim 1, wherein the finishing device is functional to finish weft threads.

9. The finishing device of claim 1 is further comprised of a cutting mechanism.

10. The finishing device of claim 1 further comprised of a second finishing mechanism and a second positioning mechanism, such that the finishing mechanism and the second finishing mechanism are independently positionable with the positioning mechanism and the second positioning mechanism respectively.

11. The finishing device of claim 1 further comprised of a plurality of finishing mechanisms and a plurality of positioning mechanisms.

12. The finishing device of claim 11 functional to produce a woven article having an aperture formed in a portion between lateral edges of the article, such that the aperture is formed after inserting affected weft threads.

13. A finishing device system, the finishing device system comprising:

at least a first positioning mechanism and at least a second positioning mechanism;

at least a first finishing mechanism coupled with the first positioning mechanism;

at least a second finishing mechanism coupled with the second positioning mechanism, wherein the first finishing mechanism is independently positionable with respect to the second finishing mechanism; said at least first and second finishing mechanism each having at least a cutter that operates to cut both warp and weft threads; and a logic unit programmably-coupled to the first positioning mechanism, the second positioning mechanism, the first finishing mechanism, and the second finishing mechanism.

* * * * *